United States Patent [19]

Cunningham et al.

[11] Patent Number: 4,972,125

[45] Date of Patent: Nov. 20, 1990

[54] PLUG-IN DIMMER MODULE FOR LIGHTING CONTROL SYSTEMS

[75] Inventors: David W. Cunningham, Los Angeles; Gregory F. Esakoff, Hungtington Beach, both of Calif.

[73] Assignee: Lee Colortran, Inc., Burbank, Calif.

[21] Appl. No.: 308,809

[22] Filed: Feb. 9, 1989

[51] Int. Cl.[5] ..... H05B 37/00

[52] U.S. Cl. ..... 315/291; 315/DIG. 4

[58] Field of Search ..... 315/291, DIG. 4; 336/59, 65, 66, 90, 96

[56] References Cited

U.S. PATENT DOCUMENTS

| | | |
|---|---|---|
| 2,783,416 | 6/1953 | Butler . |
| 3,943,397 | 3/1976 | Yancey . |
| 4,109,231 | 8/1978 | Krouse . |
| 4,769,557 | 9/1988 | Houf . |
| 4,823,069 | 4/1989 | Callahan et al. . |

FOREIGN PATENT DOCUMENTS

| | | |
|---|---|---|
| 2638618 | 8/1976 | Fed. Rep. of Germany ... 315/DIG. 4 |

OTHER PUBLICATIONS

Copyright Mar. 1985, Colortran, Inc.—192 Pack—1 page from brochure entitled Colortran, Inc.

*Primary Examiner*—Robert J. Pascal

*Attorney, Agent, or Firm*—Christie, Parker and Hale

[57] ABSTRACT

A dimmer module including a dimmer circuit for use in controlling lighting used in theatrical and architectural operations. The module features a low cost, compact, thermally efficient design incorporating circuit breakers, a power device including solid state switches, and toroidal chokes, all components being interconnected using with prefabricated tooled interconnections eliminating conventional wiring in a housing adapted to make all external connections on a plug in basis. The housing structure incorporates a built-in handle and a plurality of parallel air flow paths to maximize cooling efficiency.

17 Claims, 5 Drawing Sheets

12
44
46
32
32
28
30
54
56
26
59
161
48
63
24
53
58
10
45
49
47
51
16
50
53
81
83
20
52
85
22
55
57
18
114
116
32
40
57
38
32
42
43
34
34
30
14

PLUG-IN DIMMER MODULE FOR LIGHTING CONTROL SYSTEMS

BACKGROUND OF THE INVENTION

The present invention relates to apparatus for supplying electric power to lighting devices such as incandescent lamps and in particular to plug-in and interchangeable modules comprising a multifunctional housing containing the electrical components for controlling the light output levels from such lighting devices.

The apparatus according to the present invention is frequently referred to as a dimmer module. Dimming control systems utilizing self contained, interchangeable dimmer modules are already in use in architectural, theatrical and television applications. They control incandescent lamps and other types of lighting equipment including low voltage, fluorescent, cold cathode and other types of lighting loads. Such modules are typically provided in groups and are normally placed in racks of a number of different possible physical configurations. In one embodiment, dimmer modules are adopted to be inserted into aluminum shell and chassis systems which accept up to six plug-in dimmer modules and a plug-in control module. Output connectors are located on the rear panel of such racks and a cooling fan is likewise provided for blowing air through the chassis and carrying heat away from the module collection. Typically, a module provides two dimmer circuits of a lower power rating or one dimmer circuit of a higher power rating.

Such dimmer modules are characterized by the generation of significant amounts of heat, imposing a requirement that as much cooling as possible be provided. This cooling is typically obtained by the provision of external cooling means such as by fans, air conditioning and the like. Prior art dimmer modules have also been designed to utilize ambient air for cooling purposes but heretofore the layout of the components and the overall design of the module is such that there is a temperature gradient from one side of the dimmer module to the other thereby providing greater cooling at the one side of the module and reduced cooling because of the higher heat load at the other side.

Because such dimmer modules are used in large quantities, cost control of manufacture is also an everpresent objective. Prior art dimmer modules have been characterized by a design and physical layout and a mode of operation which entail the use of mounting hardware and conventional physical wiring of the various electrical components of the dimmer module with the attendant component and labor costs involved in providing such hardware and in making such wiring interconnections.

In a co-pending application there is described the electrical circuitry of a dimmer circuit and a method of operating the electrical circuit such as is used in the dimmer module according to the present invention in such a way as to handle greater electrical loads with the same size of components as in a conventional module or to meet the power requirements of conventional dimmer modules with a circuit design entailing substantially smaller components thereby effecting a reduction in the costs of the components and the overall assembly of the module and a comparable reduction in the heat generated by the apparatus. Thus, the features of that dimmer circuit and its method of operation make a significant contribution to overcoming the problems outlined above.

Other problems characteristic of the prior art dimmer modules resided in the manner in which the power devices were mechanically mounted and attached to a heat sink utilized to conduct heat away from the power device. Either mechanical mountings were used which typically lacked a solid thermal bond between the device and the heat sink, resulting in poor thermal transfer, or a thermal bond was attempted using heat sink grease. In this latter instance, the use of such grease was messy and awkward, particularly when the power device had to be removed and then replaced on the heat sink.

Prior art dimmers also normally utilized a separate printed circuit board on which certain components, such as the opto-isolators and gate resistors, were mounted. Typically, such a separate board was mounted above the main substrate which carried the switching devices. Such an arrangement required a number of wiring interconnections to the main substrate, all of which added significantly to the labor and expense involved in fabricating such a design.

SUMMARY OF THE INVENTION

The present invention also responds to the needs outlined above by providing a new and improved dimmer module and a power device or power assembly used in the dimmer module. The power device comprises a printed circuit (PC) substrate which is surface mounted in a thermal transfer relationship on a heat sink, with the PC substrate having a plurality of input contacts positioned thereon for receiving control signals. A plurality of PC electrical leads and PC circuit elements are also disposed on the PC substrate. A plurality of lead frames are surface mounted on the PC substrate. Each lead frame includes an integral lead frame element extending away from the PC substrate with the lead frame elements being adapted to electrically interconnect by press fit connection with other components and circuit elements of the module using prefabricated tooled interconnections. A plurality of solid state switching devices are surface mounted on the lead frames in electrical circuit relationship therewith, and preformed circuit means are provided for electrically connecting the switching devices to each other and to certain predetermined electrical leads on the PC substrate.

In one embodiment, the dimmer module according to the present invention provides two dimmer circuits of a predetermined power rating in a single housing. Included within the housing are plug-in input power terminals, signal input terminals and output power terminals. Also included in one embodiment are a pair of circuit breakers, one for each dimmer circuit, the power device referred to above which incorporates two pairs of switching devices, one pair for each dimmer circuit, a heat sink (heat radiating device) attached to the power device and two toroidal inductors, one for each dimmer circuit. The circuit breakers are connected via screw terminals to input lead frame elements of the power device. The inductors are connected to the power device by prefabricated electrical leads having press fit connections preformed in the end thereof. These connectors are connected by press fit to preformed output lead frame elements of the power device and output leads from the inductors extend to connection points integrally mounted in the housing to connect the module to a lighting load. The housing comprises upper and lower portions which are adapted to be secured together. Both portions of the housing are molded so as to provide a plurality of openings into and out of the elongated sides of the housing to provide a plurality of parallel and independent air paths for separately cooling the components within the housing with the exception of the circuit breakers. An elongated opening and hood-shaped lateral extension is formed into the upper portion. The extension provides a handle for holding, inserting and removing the dimmer module from a dimmer rack.

Essentially all wiring in the module has been eliminated by the utilization of prefabricated or preformed interconnections and the design, placement and orientation of components. A plug-in connection is built into the dimmer module to enable the module to be electrically interconnected to a power distribution bus bar in the dimmer rack in which the module is mounted. Control signal connections are also provided in a plug-in configuration at the rear of the housing adjacent the power distribution connection which are press fit connected to a control signal distribution bus. Specially formed elongated phosphor bronze contacts which are mounted in the housing extend between the control signal bus connection points on the rear of the dimmer module and contact points on a PC substrate in the power device and interconnect to said points by a pressure contact. The interior of the upper and lower portions of the housing are molded so as to provide defined compartments for the circuit breakers, the power device and heat sink, the inductors and the connecting hardware.

Because of the unique design of the airflow path, all airflow is directed over the heat generating components through small parallel passages thereby raising the air velocities and the velocity of the flow of air over these components to a significantly high value. Due to the increased flow velocities, improved cooling of the heat generating components is obtained with commensurate increase in component reliability and decrease in size, weight and cost of the inductors and the heat sinking component used with the power device as well as the other electrical components of the module.

The design and layout of the dimmer module according to the present invention produces other important advantages. By virtue of the compartmentalization of the module, the electronics of the module (the power device and circuit breakers) and all connection points are separated and shielded from the air flow paths through the module. This separation means that all contaminants such as dust, oil, moisture, etc. in the air stream flowing through the unit are prevented from being deposited on important electrical contact points with the result that the unit is rendered more reliable and less subject to corrosion, contamination and breakdown.

The housing itself is a substantial improvement over prior art designs in that all working components of the module are totally enclosed leaving no exposed wires, connections or components which can be snagged or jarred loose. Further, by recessing the input power, input signal and output load connectors, these components are also protected and shielded from possible harm and damage due to handling, installing or replacing the module.

Finally, by virtue both of the design of the housing and the insulating non-conductive materials from which it is fabricated, the dimmer module according to the present invention is thermally and electrically nonconductive compared to most prior art modules whose metallic housings can subject users to substantial risk from being burned or electrically shocked both in normal operation and even more so when the module malfunctions. By totally enclosing all components of the module, no thermally hot components are exposed or accessible to the hands of the user even when the module is being removed from the dimmer rack after full power usage. The result is a substantially safer and more reliable dimmer module than has been heretofore available in the prior art.

The dimmer module of the present invention addresses the thermal bond problem of the prior art by a fabrication process in which a ceramic substrate is used which is surface mounted to a receptacle formed in the top of a heat sink to achieve a low thermal resistance bond between the two components. The bonding of the substrate directly to the heat sink results in a near elimination of the thermal resistance between these two components, the need to use heat sink grease and the variances in mechanical fasteners.

The present design also eliminates the use of a separate board in the power device by surface mounting the opto-isolators on the main substrate and screen printing the gate resistors onto the substrate printed circuit leads, resulting in a unit which eliminates a substantial number of manufacturing steps and achieves a commensurate reduction in the cost of fabrication when compared to prior art designs.

BRIEF DESCRIPTION OF THE DRAWINGS

These and other advantages of the present invention will be better understood by reference to the drawings wherein.

DETAILED DESCRIPTION

Figure 1:
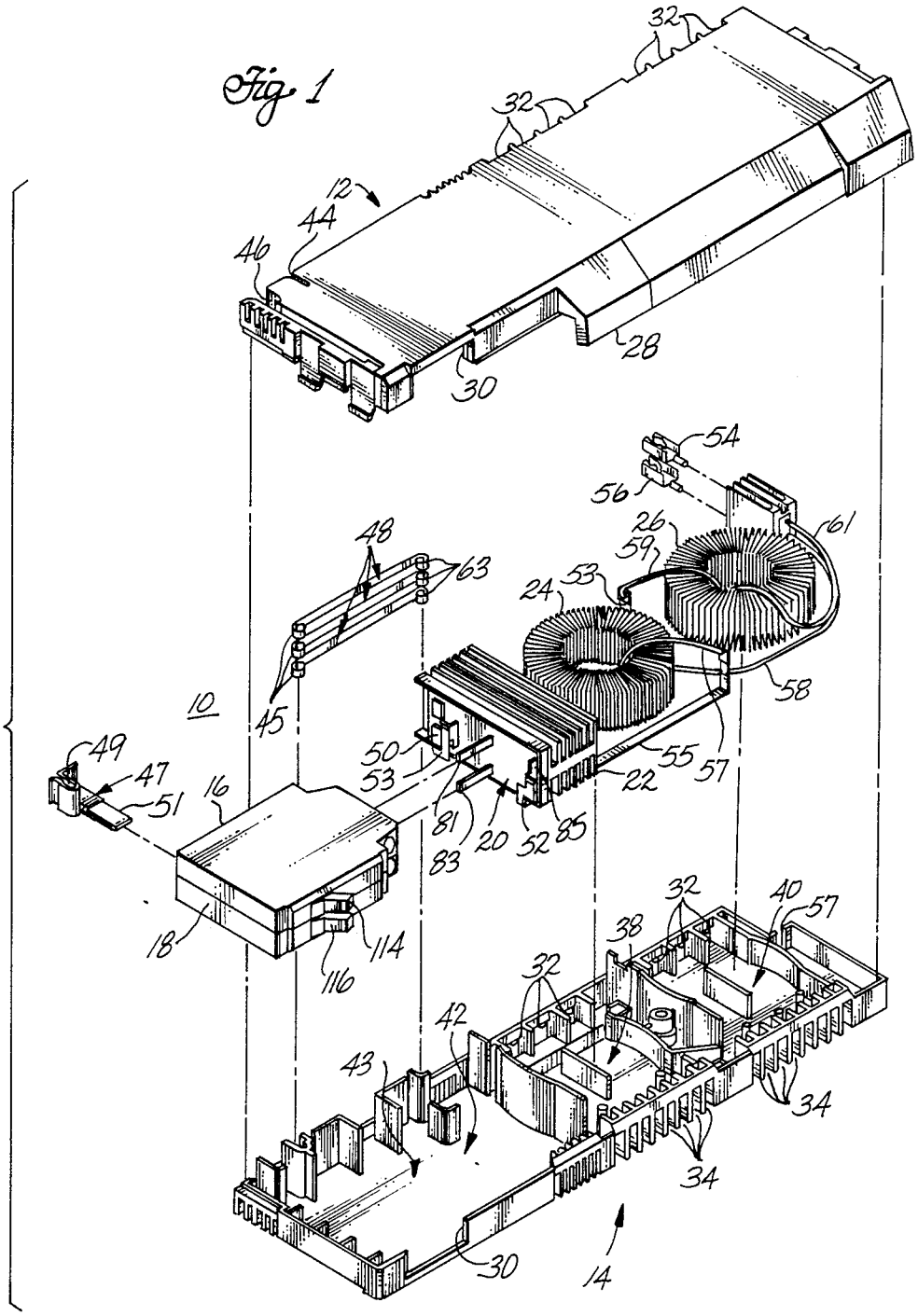
FIG. 1 is an exploded perspective view of a dimmer module according to the present invention.
Figure 2:
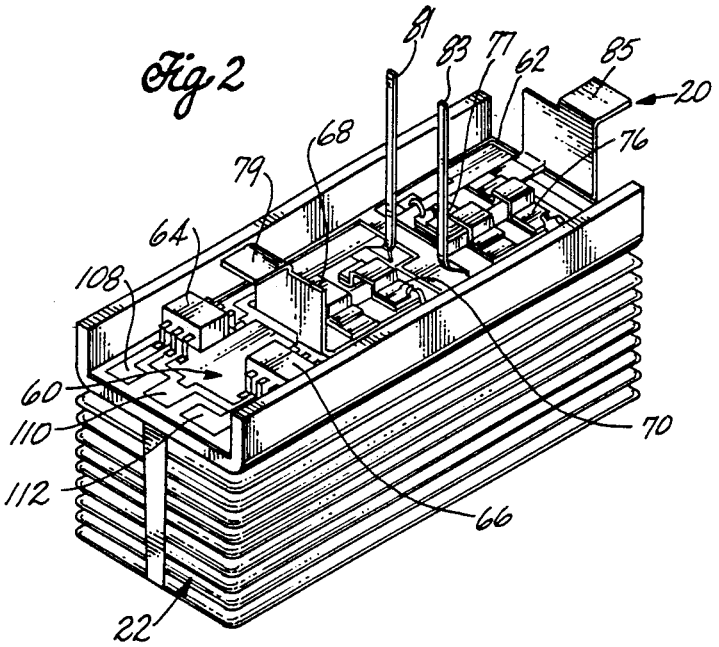
FIG. 2 is a perspective view of the power device used in the dimmer module according to the present invention.

The physical design and arrangement of the dimmer module components are shown in the exploded view of FIGS. 1 and 2. As shown therein, the dimmer module 10 comprises an assembly which includes a housing 11 that is constructed of a top portion 12 and a bottom portion 14. Portion 14 is laid out and configured to provide compartments and areas to receive the components of dimmer module. The components of the dimmer module include two circuit breakers 16, 18, a power device 20 mounted in a receptacle formed in a finned heat sink or heat radiating device 22, and a pair of toroidal chokes 24, 26.

The upper part of the housing is configured so as to provide a hood-shaped extension 28 which serves also to provide a handle for picking up and manipulating the dimmer module. An aperture 30 is located adjacent hood/handle 28 to permit the toggle switches 114, 116 on circuit breakers 16, 18 to extend to the exterior of the housing.

A plurality of air flow openings 32, 34 are located on the rear and front sides respectively of the upper and lower portions 12, 14. Also shown in portion 14 are a pair of compartments 38, 40 for receiving inductors (the toroidal chokes) 24, 26, respectively. The top portion 12 is preferably fabricated of a high impact low warpage material such as Lexan®. The bottom portion 14 is preferably fabricated of a high temperature engineering plastic such as Rynite®. Lower portion 14 is also molded so as to define areas 42, 43 for receiving the power device 20 and heat sink assembly 22 and circuit breakers 16, 18. Area 42 is provided for receiving device 20 and assembly 22 and area 43 is provided for circuit breakers 16, 18 respectively.

In fabrication, the top and bottom portions are molded so as to define a pair of slots 44, 46 at the rear of the housing. A press fit connector 47 is mounted in slot 46 for connection to a bayonet type fitting on a power distribution bus bar (not shown) provided in the dimmer rack in which the module is mounted. Connector 47 has a female portion 49 for engagement with the power source and a male portion 51 which plugs into a receptacle (not shown) between the circuit breakers for connecting input power to breakers 16, 18 respectively. Also shown in the exploded view of FIG. 1 are three elongated phosphor bronze signal lead connectors 48 which extend from control signal connection slot 44 to contact pads 10B, 110, 112 on the PC board 60 of power device 20. The rolled ends 45 of connectors 48 engage and are compressed by the contacts 122 on a control signal distribution board 118 (see FIG. 5) mounted at the rear of the rack in which the module is mounted. The rolled ends 63 of contacts 48 bear against pads 108, 110, 112 in a pressure contact relation to make electrical interconnection of the input control signals to PC substrate 60.

Input lead frame elements 81, 83 extending outwardly from power device 20 extend toward circuit breakers 16, 18 and engage a receptacle (not shown) on each breaker for communicating input power from the circuit breakers to the pair of dimmer circuits incorporated into power device 20.

Output lead frame elements 79, 85 are adapted to be press-fit connected to clip connectors 50, 52 which in turn are connected to prefabricated built in flat electrical leads 53, 55 which extend from the power device 20 to the input ends 57, 59 of the toroids of inductors 24, 26. The output ends 58, 61 of the toroidal coils are extended from the output side of inductors 24, 26 to pressure contacts 54, 56 mounted in a connector housing 41 located at the rear of housing 11. Pressure contacts 54, 56 provide the output connection to which a load such as a group of incandescent lamps driven by the dimmer module is connected.

Figure 3C:
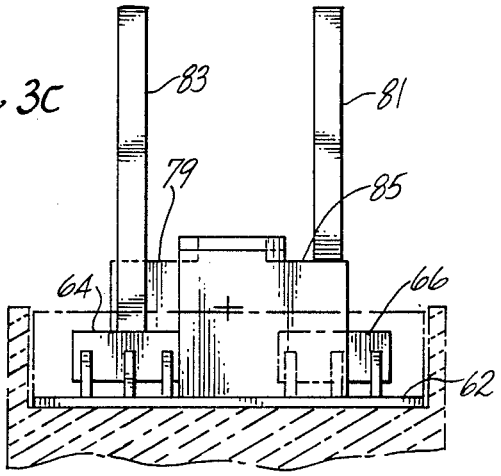
FIG. 3C is a side elevation view of the power device of FIG. 2.

Referring now to FIGS. 2 and 3, the components of the power device are shown. As illustrated therein, a printed circuit substrate (PC) 60 is mounted in and secured in a thermal transfer relation to a thermally conductive receptacle 62 formed in the top of the heat sink 22. The components of the power device are shown in FIGS. 2 and 3 and include two opto-isolators 64, 66 and four silicon-controlled rectifiers (SCR) 68, 70, 76, 77. SCR's 68, 70 constitute a first pair and are connected in anti-parallel circuit relation. SCR's 76, 77 constitute a second pair and are also connected in anti-parallel circuit relation. SCR's 68, 70, 76, 77 are respectively surface mounted on lead frames 80, 78, 82, 84 in conductive electric circuit relation therewith. Lead frames 80, 78, 82, 84 are in turn surface mounted in electric circuit relation on conductive pads which are part of the printed circuit substrate PC wiring leads. Lead frame elements 81, 79 transmit input power to the first pair of SCR's 68, 70 and the second pair 76, 77, respectively, from the circuit breakers.

Figure 3B:
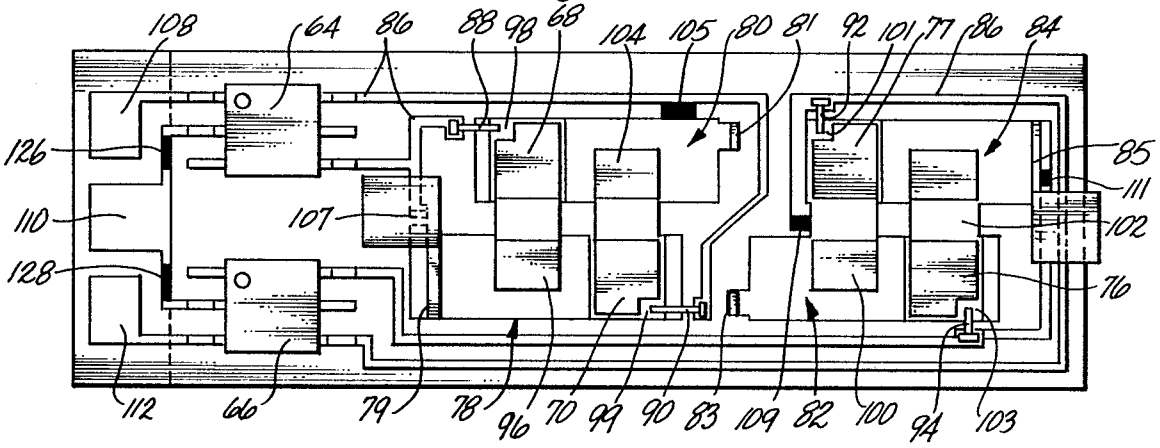
FIG. 3B is a plan view of the power device of FIG. 2.
Figure 3A:
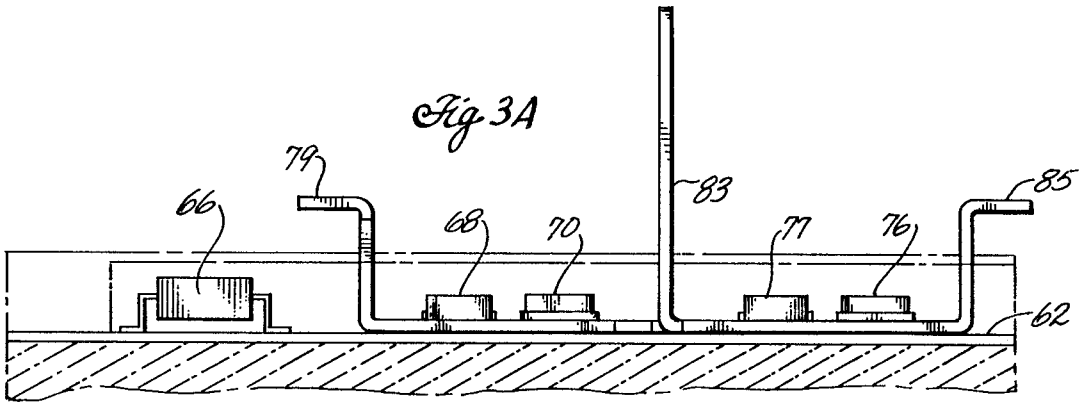
FIG. 3A is a front elevation view of the power device of FIG. 2.

Further details of the power device are shown in FIG. 3A. Lead frames 78, 82 are shown in elevation in FIG. 3A as attached to PC substrate 60. SCR 70 is surface mounted on lead frame 78 as is seen in FIGS. 3A and 3B. SCR 68 is surface mounted on lead frame 80. As seen in FIG. 3B, SCR 76 is surface mounted on lead frame 82 and SCR 77 is surface mounted on lead frame 84. Lead frame 78 has an integrally formed elongated lead frame element 79 extending vertically upward from the plane of the lead frame and likewise lead frame 80 has an elongated integrally formed lead frame element 81 extending vertically upward from the plane of the PC substrate. Similarly, lead frames 82, 84 have shorter specially formed lead frame elements 83, 85 extending upwardly from the plane of the substrate a shorter distance than elements 79, 81. Screen printed gate resistors 105, 107, 109, 111 are shown in FIG. 3B and are respectively part of the gate electrode circuit of SCR's 68, 70, 76 and 77. Screen printed resistors 126, 128 function as current limiting resistors to the opto-isolators.

The electric leads of the screen printed circuitry of PC substrate 60 are shown at 86. A control electrode (the gate electrode) 98 of SCR 68 is connected to PC substrate wiring 86 by means of strap 88 while a control electrode (the gate electrode) 99 of SCR 70 is connected to the PC substrate wiring 86 by strap 90. Similarly, the control electrode (the gate electrode) 101 of SCR 77 is connected to the PC substrate wiring by strap 92 and the control electrode (the gate electrode) 103 of SCR 76 is connected to the PC substrate wiring 86 by strap 94.

Lead frame 78 is electrically interconnected to SCR 68 by means of strap 96 while lead frame 80 is connected to SCR 70 by means of strap 104. Similarly, lead frame 82 is connected by means of strap 100 to SCR 77 and lead frame 84 is connected to SCR 76 by means of strap 102. The connection points of the control electrodes 98, 99, 101, 103 to the PC substrate are in turn connected by means of the PC electrical leads 86 to the opto-isolators 64, 66. The opto-isolators are, on their input side, connected by PC substrate printed circuit wiring to the control signal contact pads 108, 110 and 112. The control signal contact pads on the printed circuit substrate are adapted to physically contact and electrically interconnect with the ends 63 of elongated contacts 48.

Figure 4C:
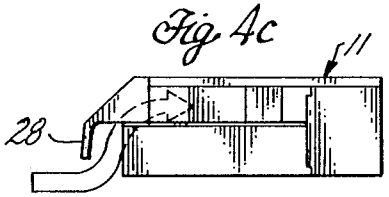
FIG. 4C is a side elevation view of the module shown in FIG. 4A.
Figure 4A:
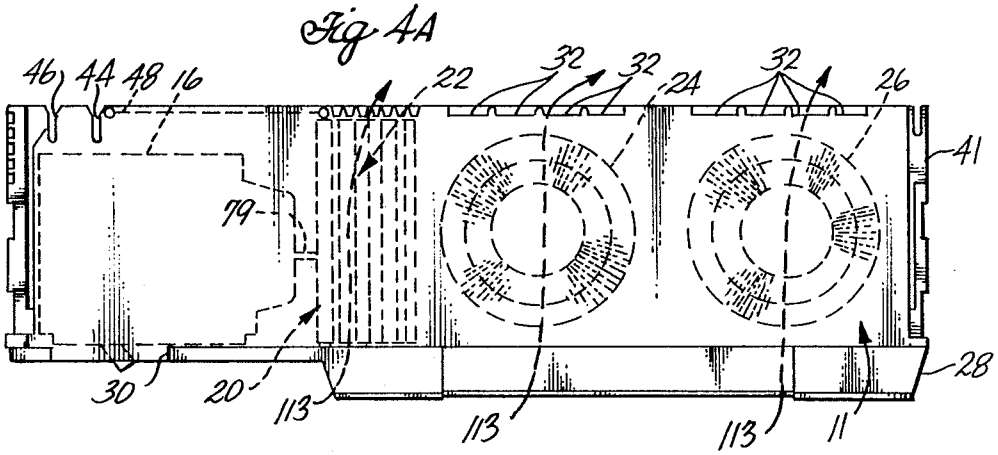
FIG. 4A is a plan view of the assembled dimmer module showing the components in ghosted outline.
Figure 4B:
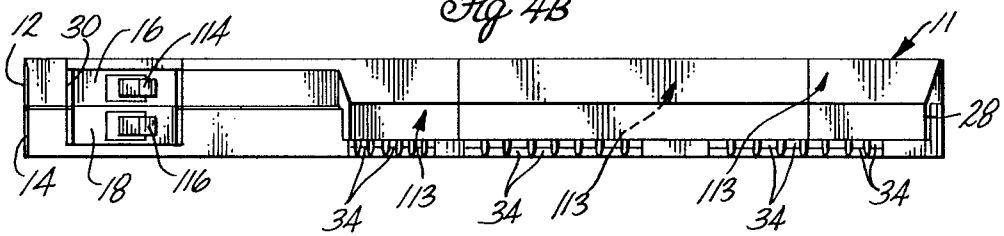
FIG. 4B is a front elevation view of the module shown in FIG. 4A.

The physical design and layout of the module according to the present invention greatly enhances its inherent cooling capability. As seen in FIGS. 4A, 4B and 4C, the air flow paths are illustrated. The module 10 is depicted therein and in FIG. 4A, there is shown in phantom, the chokes 24, 26, the power device 20, the heat sink 22, and the circuit breakers 16, 18. FIG. 4C in particular, illustrates the upper portion 12 of the housing with the forwardly extending hood or extension 28 which is open on its underside and communicates with large apertures opening into the interior of the module in which the power device, heat sink and chokes are located. The extension 28 serves as a handle, a hood and a channel for the induction of air as shown by arrows 113. Air flow velocities at the rate of approximately 300–500 feet per minute are produced by this design and such high air flow into the module through front apertures 34 and out through rear apertures 32 substantially enhance the cooling capability of the present unit.

Figure 5:
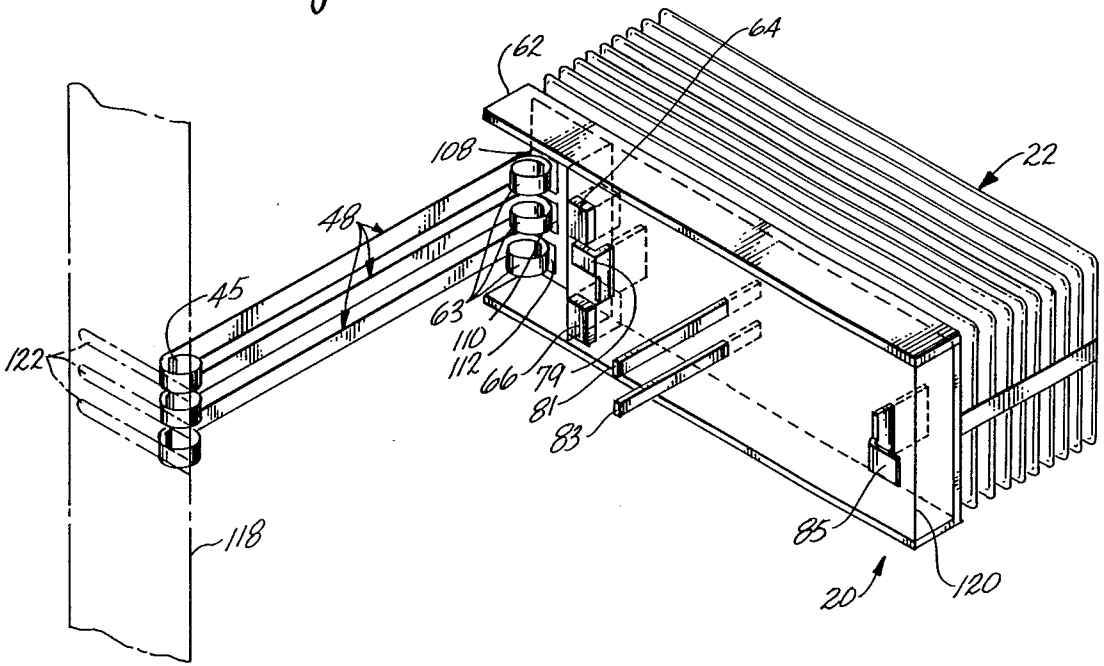
FIG. 5 is a detailed view of the power device and heat sink showing the spring loaded interconnection elements extending from a control signal distribution bus to the input contacts of the power device.

Finally, additional details of the control signal elongated contact leads 48, the power unit 20 and heat sink 22 are shown in FIG. 5. As shown therein, the control signal pads 108, 110 and 112 on the printed circuit board 60 are contacted by rolled ends 63 on the signal contact leads 48. As shown therein, the contacts make a pressure electrical contact with the pads 108, 110, 112 without the necessity of conventional wiring. The opposite ends 45 of signal contact leads 48 bear against a similar set of contacts on a control signal distribution card or bus 118 which is incorporated into the rack in which the dimmer modules are physically mounted.

When the power device is fully assembled it is encapsulated in potting material 120 for insulation and protection of the dimmer circuit components. The potting material extends from the end of PC substrate 60 opposite contact pads 108, 110, 112 to a point just beyond opto-isolators 64, 66 as can also be seen in FIG. 3A so as to leave pads 108, 110, 112 exposed to make electrical interconnection with contacts 48. The lead frame elements 81, 83 which plug into and establish contact with circuit breakers are shown in FIG. 5 extending upwardly and out of the potting material. Likewise, lead frame elements 79, 85, the output leads from each of the pairs of anti-parallel SCR's are also shown extending out of the potting material with formed ends to engage press-fit connectors 50, 52.

What is claimed is:

1. A dimmer module comprising:

a housing having a top portion and a bottom portion, said top and bottom incorporating plug-in electric contacts for input power, control signals and load connection, at least one circuit breaker located within the housing;

a power device comprising at least one dimmer circuit having at least one input lead frame element secured into electrical contact with the circuit breaker and at least one output lead frame element;

a heat sink attached to the power device in thermal transfer relation therewith; and at least one toroidal inductor electrically connected to the output lead frame element at its input side and to the load connection at its output side whereby the module can be mechanically plugged into, and removed from, sources of input power and control signals and output load connection points.

2. A module according to claim 2 wherein the power device comprises a pair of dimmer circuits, each circuit having an input lead frame element and an output lead frame element; and the module further comprises a first and second circuit breaker and a first and second inductor, each of said circuit breakers and inductors being associated with a respective one of said dimmer circuits and in electric circuit relation therewith.

3. A module according to claim 2 wherein the interior of the top and bottom portions is formed so as to receive and retain the circuit breakers, the power device and attached heat sink and said first and second inductors in a side by side relation in the direction of elongation of the housing.

4. A module according to claim 3 where the top and bottom portions have a plurality of apertures formed in the elongated sides thereof to define a plurality of independent parallel air flow paths through the housing transverse to the direction of elongation of the housing.

5. A module according to claim 4 wherein a section of the front side of the top portion is formed so as to extend outwardly from the perimeter of the top portion to define a handle for grasping and moving the dimmer module.

6. A module according to claim 5 including a plurality of specially formed elongated electrical contact elements mounted at the rear of the housing extending between the control signal input contacts on the housing and input contact points on the printed circuit substrate.

7. A power device for a dimmer module comprising:

a printed circuit (PC) substrate having a plurality of input contacts disposed thereon for receiving control signals and a plurality of PC electrical leads and circuit elements disposed thereon extending from the contacts for interconnecting components of the device;

a plurality of lead frames mounted on the PC substrate in electric circuit relation with the PC leads, each lead frame having an integral lead frame element extending away from the PC substrate, said lead elements being adapted to be electrically connected by a secure connection to other circuit elements;

solid state switching devices mounted on said lead frames in electric circuit relation therewith; and preformed circuit means for electrically interconnecting the switching devices to each other and to certain predetermined electrical leads on the PC substrate.

8. A device according to claim 7 including isolating means connected in electric circuit relation between the input contacts and the switching devices.

9. A device according to claim 8 wherein the switching devices are a pair of silicon controlled rectifiers (SCR) having control electrodes for switching the SCR on and off, one of said SCR's being surface mounted to an input lead frame and the other of said SCR's being surface mounted to an output lead frame, said SCR's being connected to each other in anti-parallel circuit relation by first preformed circuit means.

10. A device according to claim 9 wherein the isolating means is an opto-isolator.

11. A device according to claim 10 wherein the PC input contacts, PC leads, PC circuit elements, opto-isolator, input lead frame, output lead frame and pair of SCR's comprise a dimmer control circuit.

12. A device according to claim 11 wherein the circuit means connect predetermined PC leads and the SCR control electrodes by second preformed circuit means.

13. A device according to claim 12 wherein the device comprises a single dimmer circuit of a first predetermined power rating.

14. A device according to claim 13 wherein the device comprises two dimmer circuits, each circuit having a second predetermined power rating lower than said first rating, the device also comprising a first and second opto-isolator and second pair of anti-parallel connected SCR's, said first opto-isolator and first pair of SCR's comprising a first dimmer circuit and said second opto-isolator and second pair of SCR's comprising a second dimmer circuit, each dimmer circuit having a set of lead frames.

15. A device according to claim 14 wherein the PC substrate has three PC input contacts, one of said contacts being common to each of said two dimmer circuits.

16. A device according to claim 15 wherein the side of the PC substrate opposite the PC contacts and leads is bonded to heat sink means by a low thermal resistance bond.

17. A device according to claim 7 wherein a potting compound is deposited over the elements and the PC substrate of the power device such that only the upper portions of the lead frame elements and the PC input contacts are exposed.

* * * * *

UNITED STATES PATENT AND TRADEMARK OFFICE

CERTIFICATE OF CORRECTION

PATENT NO. : 4,972,125

DATED : November 20, 1990

INVENTOR(S) : D.W. Cunningham; G.F. Esakoff

It is certified that error appears in the above-identified patent and that said Letters Patent is hereby corrected as shown below:

On the Front Page:

[75] Inventors, change "Hungtington Beach" to -- Huntington Beach --.

Column 1, line 47, change "everpresent" to -- ever-present --.

Column 5, line 38, after "pads" delete "10B" and insert therefor -- 108 --.

Column 6, line 65, change "air flow" to -- airflow --.

Column 7, line 8, change "Air flow" to -- Airflow -- .

Column 10, line 10, change "air flow" to --airflow--.

UNITED STATES PATENT AND TRADEMARK OFFICE

CERTIFICATE OF CORRECTION

PATENT NO. : 4,972,125

DATED : November 20, 1990

INVENTOR(S) : D.W. Cunningham; G.F. Esakoff

It is certified that error appears in the above-identified patent and that said Letters Patent is hereby corrected as shown below:

Column 7, line 62, after "claim" delete "2" and insert therefor -- 1 --.

Column 8, line 12, after "parallel" change "air flow" to -- airflow --.

Column 9, line 5, after "opto-isolator and" and before "second" insert -- a first and --.

Signed and Sealed this

Twenty-eighth Day of April, 1992

*Attest:*

HARRY F. MANBECK, JR.

*Attesting Officer*

*Commissioner of Patents and Trademarks*